US008243939B2

(12) United States Patent
Perman

(10) Patent No.: US 8,243,939 B2
(45) Date of Patent: Aug. 14, 2012

(54) HEARING INSTRUMENT WITH IMPROVED INITIALISATION OF PARAMETERS OF DIGITAL FEEDBACK SUPPRESSION CIRCUITRY

(75) Inventor: Shawn Perman, Roskilde (DK)

(73) Assignee: GN ReSound A/S, Ballerup (DK)

( * ) Notice: Subject to any disclaimer, the term of this patent is extended or adjusted under 35 U.S.C. 154(b) by 625 days.

(21) Appl. No.: 12/389,297

(22) Filed: Feb. 19, 2009

(65) Prior Publication Data

US 2010/0166198 A1 Jul. 1, 2010

(30) Foreign Application Priority Data

Dec. 30, 2008 (DK) ..... 2008 01847
Feb. 3, 2009 (DK) ..... 2009 00160

(51) Int. Cl.
*H04R 29/00* (2006.01)
*H04R 25/00* (2006.01)

(52) U.S. Cl. ..... 381/60; 381/318

(58) Field of Classification Search ..... 381/83, 381/93, 60, 312, 317, 318, 320, 321
See application file for complete search history.

(56) References Cited

U.S. PATENT DOCUMENTS 5,619,580 A 4/1997 Hansen
5,680,467 A 10/1997 Hansen
6,128,392 A * 10/2000 Leysieffer et al. ..... 381/318
6,498,858 B2 12/2002 Kates
7,058,182 B2 * 6/2006 Kates ..... 381/60
7,162,044 B2 * 1/2007 Woods ..... 381/93
2002/0064291 A1 5/2002 Kates et al.
2002/0176584 A1 11/2002 Kates
2004/0120535 A1 6/2004 Woods
2005/0226447 A1 10/2005 Miller
2008/0175401 A1 7/2008 Frohlich

FOREIGN PATENT DOCUMENTS

EP 0415677 3/1991
EP 1439736 7/2004
WO 01/10170 2/2001
WO 2005081584 9/2005

OTHER PUBLICATIONS

Office Action dated Jul. 20, 2009 for Danish Patent Application No. PA 2008 01847.
International Type Search Report dated Sep. 3, 2009 for DK 200801847.

* cited by examiner

*Primary Examiner* — Evan Pert
*Assistant Examiner* — Scott Stowe
(74) *Attorney, Agent, or Firm* — Vista IP Law Group, LLP

(57) ABSTRACT

A method of modelling a feedback path from a receiver to a microphone in a hearing instrument, includes applying an electronic probe signal with an increasing level as a function of time to the receiver for conversion of the electronic probe signal into an acoustic probe signal output by the receiver, monitoring values of a first quality parameter calculated based at least in part on recorded microphone output signal, and after the first quality parameter reaches a predetermined first threshold value, determining at least one parameter of the feedback path based at least in part on the recorded microphone output signal values.

20 Claims, 5 Drawing Sheets

Figure 1:
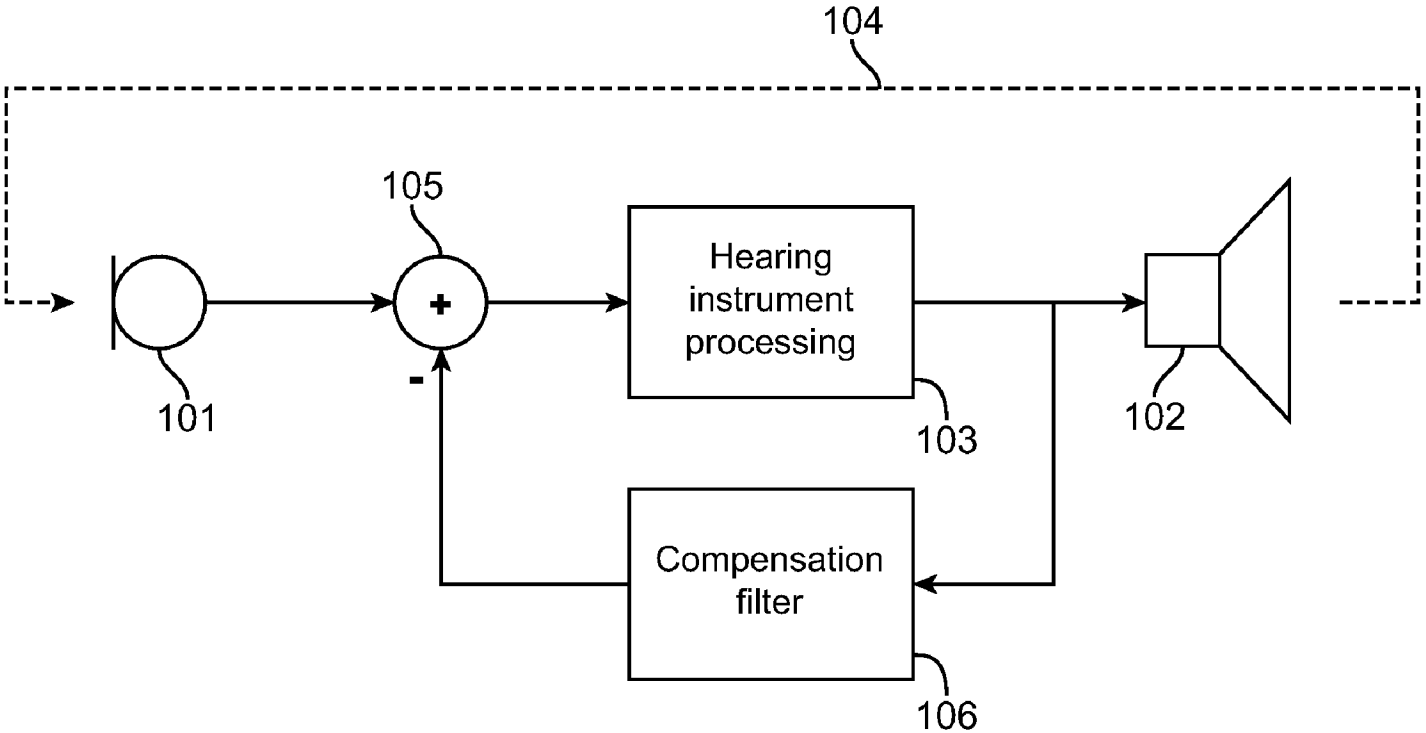
FIG. 1 (PRIOR ART)

HEARING INSTRUMENT WITH IMPROVED INITIALISATION OF PARAMETERS OF DIGITAL FEEDBACK SUPPRESSION CIRCUITRY

RELATED APPLICATION DATA

This application claims priority to and the benefit of Danish Patent Application No. PA 2009 00160, filed on Feb. 3, 2009, and Danish Patent Application No. PA 2008 01847, filed on Dec. 30, 2008, the entire disclosure of both of which is expressly incorporated by reference herein.

FIELD

The present application relates to a hearing instrument, such as a hearing aid, with digital feedback suppression circuitry having parameters that are initialised, e.g. during fitting of the hearing instrument to a specific user.

BACKGROUND & SUMMARY

Feedback is a well known problem in hearing instruments and systems for suppression and cancellation of feedback are well-known in the art, see e.g., U.S. Pat. No. 5,619,580, U.S. Pat. No. 5,680,467 and U.S. Pat. No. 6,498,858.

Conventionally, a Digital Feedback Suppression Circuit is employed in hearing instruments to suppress the feedback signal from the receiver output. During use, the Digital Feedback Suppression Circuit estimates the feedback signal, e.g. utilising one or more digital adaptive filters that model the feedback path. The feedback estimate from the Digital Feedback Suppression Circuit is subtracted from the microphone output signal to suppress the feedback signal.

The feedback signal may propagate from the receiver back to the microphone along an external signal path outside the hearing instrument housing and along an internal signal path inside the hearing instrument housing.

External feedback, i.e. propagation of sound from the receiver to the microphone of the hearing instrument along a path outside the hearing instrument, is also known as acoustical feedback. Acoustical feedback occurs, e.g., when a hearing instrument ear mould does not completely fit the wearer's ear, or in the case of an ear mould comprising a canal or opening for e.g. ventilation purposes. In both examples, sound may "leak" from the receiver to the microphone and thereby cause feedback.

Internal feedback may be caused by sound propagating through air inside the hearing instrument housing, and by mechanical vibrations in the hearing instrument housing and in components inside the hearing instrument housing. The mechanical vibrations are generated by the receiver and are transmitted to other parts of the hearing instrument, e.g. through receiver mounting(s). In some hearing instruments, the receiver is flexibly mounted in the housing, whereby transmission of vibrations from the receiver to other parts of the hearing instrument is reduced.

WO 2005/081584 discloses a hearing instrument having two separate digital feedback suppression circuits, namely one for compensation of the internal mechanical and acoustical feedback and one for compensation of the external feedback.

The external feedback path extends "around" the hearing instrument and is therefore usually longer than the internal feedback path, i.e. sound has to propagate a longer distance along the external feedback path than along the internal feedback path to get from the receiver to the microphone. Accordingly, when sound is emitted from the receiver, the part of it propagating along the external feedback path will arrive at the microphone with a delay in comparison to the part propagating along the internal feedback path. Therefore, it is preferred that the separate digital feedback suppression circuits operate on first and second time windows, respectively, and that at least a part of the first time window precedes the second time window. Whether the first and second time windows overlap or not, depends on the length of the impulse response of the internal feedback path.

While external feedback may vary considerably during use, internal feedback is more constant and typically coped with during the manufacturing process.

It is well-known that accurate initialisation of the Digital Feedback Suppression Circuit is essential for effective suppression of feedback in the hearing instrument. Although in principle, an adaptive filter automatically adapts to changes of the feedback path, there are limitations to the extent and accuracy of feedback path changes that the adaptive filter can track. However, accurate initialization of the Digital Feedback Suppression Circuit leads to fast and accurate modelling of the feedback path response and effective feedback suppression during subsequent operation by provision of a starting point for the adaptation that is close to the desired end result. The initialisation may take place during a fitting session and possibly whenever the user turns the hearing instrument on.

Typically, the Digital Feedback Suppression Circuit is initialized during fitting of the hearing instrument to a specific user. The hearing instrument is connected to a PC, and a probe signal is transmitted to the receiver, and based on the microphone output signal that includes a response to the probe signal, the impulse response of the feedback path is estimated. Typically, the probe signal is 10 seconds long and has a high level that disturbs the user. In order to allow the user to adapt to the probe signal, the probe signal is ramped linearly on a logarithmic scale from zero during one second preceding the ten seconds constant level probe signal. The received microphone output signal is transmitted to the PC and the respective impulse response is calculated. Then the PC determines the parameters required by the Digital Feedback Suppression Circuit, e.g. filter coefficients of fixed digital filters and initial filter coefficients of an adaptive digital filter, to be capable of modelling the feedback path.

In a hearing instrument with more than one microphone, e.g. having a directional microphone system, the hearing instrument may comprise separate Digital Feedback Suppression Circuits for each microphone that are initialised separately utilising the same probe signal.

US 2002/0176584 discloses initialisation of a Digital Feedback Suppression Circuit wherein the level of the probe signal is adjusted in accordance with the ambient noise level. The ambient noise level is determined based on the microphone output, and a minimum probe signal is used when the ambient noise level is below a low threshold value. If the ambient noise level is in between the low threshold value and a high threshold value, the probe signal level is increased so that the ratio of the probe signal level to the minimum probe level is equal to the ratio of the ambient noise level to its threshold value. The probe signal level is not allowed to exceed a maximum value selected for user comfort. If the ambient noise level is above the high threshold value, the probe signal level is limited to the maximum value.

Hearing instrument users have complained about discomfort and pain during the initialisation process.

Recently, open solutions have emerged. In accordance with hearing instrument terminology, a hearing instrument with a housing that does not obstruct the ear canal when the housing is positioned in its intended operational position in the ear canal; is categorized "an open solution". The term "open solution" is used because of the passageway between a part of the ear canal wall and a part of the housing allowing sound waves to escape from behind the housing between the ear drum and the housing through the passageway to the surroundings of the user. With an open solution, the occlusion effect is diminished and preferably substantially eliminated.

Typically, a standard sized hearing instrument housing which fits a large number of users with a high level of comfort represents an open solution.

Open solutions may lead to feedback paths with long impulse responses, since the receiver output is not separated from the microphone input by a tight seal in the ear canal. This makes the feedback path relatively open leading to a long impulse response which may further increase the required duration of the probe signal for estimation of the feedback path.

Thus, it is desirable to provide a way of initialising the Digital Feedback Suppression Circuit that reduces user discomfort during the initialisation process.

Accordingly, a new initialisation process is provided wherein the level and duration of the probe signal is kept at a minimum required for appropriate initialization of the Digital Feedback Suppression Circuit. Initially, in one embodiment, the probe signal is ramped, e.g. linearly on a logarithmic scale, from a low level, such as an inaudible level, e.g. a zero level, while the value of a first quality parameter is monitored. When the first quality parameter value has reached a predetermined first threshold value, the probe signal is kept constant at the corresponding signal level while the value of a second quality parameter is monitored. When the second quality parameter value has reached a predetermined second threshold value, the probe signal level is lowered again, e.g. to an inaudible level, e.g. is turned off.

The signal level may be defined as the sound pressure level (SPL) the hearing instrument generates, e.g. in front of the tympanic membrane, or at the acoustic input of a microphone of the hearing instrument or of a separate microphone that is not a part of the hearing instrument.

The sound pressure level is a logarithmic measure of the rms sound pressure of a sound relative to a reference value. It is measured in decibels (dB). The commonly used reference sound pressure in air is 20 μPa (rms), which is usually considered the threshold of human hearing.

The sound pressure level is controlled by the signal level, e.g. the rms value, of the electronic input signal to the receiver of the hearing instrument.

The resulting sound pressure level need not be determined. Preferably, the resulting maximum sound pressure level reached will be a function of the first threshold value and optionally the second threshold value of the first and second quality parameters, respectively.

The sound pressure level may be determined at selected frequencies, or within a selected frequency range, or as a function of frequency, or, the sound pressure level may be determined in substantially the whole frequency range of the probe signal.

During monitoring of the quality parameters, the quality parameter in question is calculated repeatedly based on the microphone output signal and successive values of the quality parameter may be compared to the relevant first or second threshold value.

Increasing values of the first or second quality parameter may indicate increased quality of the microphone output signal. For a quality parameter of this type, the quality parameter starts at a low value and gradually increases. The respective first or second threshold value is reached when the quality parameter in question is larger than or equal to the respective threshold value.

For another type of quality parameter, decreasing values of the quality parameter indicate increased quality of the microphone output signal. For a quality parameter of this type, the quality parameter starts at a high value and gradually decreases. The respective threshold value is reached when the quality parameter in question is less than or equal to the threshold value.

For example, the first quality parameter may relate to differences in the determined impulse response of the feedback path. Ramping of the probe signal may be stopped when the determined impulse response has become sufficiently stable, i.e. when the first quality parameter, being a measure of a difference in successively determined impulse responses, is equal to or less than the first threshold value.

As another example, the first quality parameter may relate to the signal level at a microphone of the hearing instrument, or at an external microphone that is not a part of the hearing instrument, for example the first quality parameter may be equal to, or a function of, the rms value of the electronic output signal of the microphone in question.

Thus, a method is provided of modelling a feedback path from a receiver to a microphone in a hearing instrument, comprising the acts of transmitting an electronic probe signal to the receiver for conversion into an acoustic probe signal output by the receiver while recording the microphone output signal, including increasing the level of the probe signal while monitoring values of a first quality parameter calculated based on the recorded microphone output signal until the first quality parameter has reached a predetermined first threshold value, and subsequently determining at least one parameter of the feedback path based at least in part on the recorded output signal.

The act of transmitting the probe signal may further comprise refraining from further increasing the level of the probe signal when the first quality parameter has reached the predetermined first threshold value.

The act of transmitting the probe signal may further comprise monitoring values of a second quality parameter calculated based on the recorded microphone output signal, and terminating transmission of the probe signal to the receiver when the determined second quality parameter has reached a predetermined second threshold value.

The first quality parameter and the second quality parameter may be identical.

The method may further comprise estimating the impulse response of the feedback path.

At least one of the first quality parameter and the second quality parameter may be a parameter of the impulse response.

The parameter of the impulse response may be selected from the group consisting of the peak to peak ratio of head and tail parts of the impulse response, noise to noise ratio of head and tail parts of the impulse response, and peak to signal-to-noise (or signal-noise) ratio of the impulse response.

In one embodiment, the Digital Feedback Suppression Circuit comprises a fixed IIR filter, and an adaptive FIR filter. The adaptive FIR filter coefficients may be updated based on minimisation of least means squared error. An adaptive filter may also be utilised that is allowed to adapt during the initialisation process. After initialisation, the filter continues its operation with frozen filter coefficients so that the filter operates as a static filter.

The probe signal may be a maximum length sequence, e.g. a repeated 255-sample maximum length sequence, a broadband noise signal, etc. With a maximum length sequence, generation of standing waves is avoided.

The recorded microphone output signal that includes a response to the probe signal may be uploaded to an external computer that is adapted for estimating the feedback signal path and for transferring the estimate to the Digital Feedback Suppression Circuit, e.g. by transferring determined parameters to the Digital Feedback Suppression Circuit, such as filter coefficients of fixed digital filters and of an adaptive digital filter.

In one embodiment, the Digital Feedback Suppression Circuit comprises an adaptive filter that is allowed to adapt during transmission of the probe signal to the receiver. Initialisation may be terminated when the changes of the filter coefficients have become less than a predetermined threshold value constituting the second threshold value, the change of the filter coefficients from one adaptation cycle to the next constituting the second quality parameter value.

According to the provided method, user discomfort is reduced or eliminated due to use of a probe signal with a signal level or amplitude which is sufficiently large to facilitate estimation of the feedback path, but not larger than required.

Determination of the required probe signal level may be performed starting transmission of the probe signal to the receiver from a low level, e.g. a inaudible level, such as 0 $dB_{SPL}$, and gradually increasing the level of the probe signal until the impulse response of the feedback path is deemed to be of sufficient quality for determination of the required parameters, e.g. by monitoring changes in a determined parameter of the impulse response constituting the first quality parameter and stopping increase of the level of the probe signal when the changes are less than the first threshold value.

A maximum allowable signal level and duration of the probe signal may be imposed, e.g., which are equivalent to what the standard initialization signal level and duration would have been according to the conventional initialisation process.

Likewise, transmission of the probe signal at the determined constant level may be stopped when impulse response determination is deemed to be of sufficient quality thereby making duration of the probe signal as short as possible.

The determined required level of the probe signal may vary in dependence of the type and model of the hearing instrument, and the type of fitting (open/closed).

The rate of increase of the probe signal level may be varied in dependence of the expected required signal level and a predetermined time period set to reach the expected required signal level. The expected signal level may for example be 85 $dB_{SPL}$ for a non-hearing impaired user. At the level of 85 $dB_{SPL}$, there is generally no discomfort experienced by a person of normal hearing. It should be noted that hearing impaired users are generally subjected to far higher initialization levels, such as 102 $dB_{SPL}$. The level may reach the maximum of the output level of the device (e.g. 120 $dB_{SPL}$) but is limited at a level which limits distortion caused from overdriving the receiver.

Calculations of the first and second quality parameters and parameters of a Digital Feedback Suppression Circuit may be performed in a computer external to the hearing instrument and thus, a bi-directional data communication link may be established between the hearing instrument and the external computer as is well-known in the art. The external computer may receive the microphone output signal and may control the probe signal generator, e.g., start and stop signal generation by the probe signal generator, current signal level of the probe signal generator output, etc., in accordance with calculations of the first and possibly the second quality parameter.

Calculations and control required to perform the initialisation process may be shared between the external computer and the hearing instrument in a variety of ways, e.g. all required tasks of the initialisation process may be performed in the hearing instrument provided that the signal processor has sufficient computational power and memory for the corresponding program to be executed.

Thus, a hearing instrument is provided comprising a microphone for converting incoming sound into an audio signal, a Digital Feedback Suppression Circuit for modelling a feedback path of the hearing instrument, a signal processor for processing the compensated audio signal, a receiver connected to an output of the signal processor for converting the processed signal into a sound signal, a probe signal generator controlled by the signal processor for generation of a probe signal to the receiver for conversion into an acoustic probe signal output by the receiver, and wherein the signal processor is further configured for recording the audio signal and controlling the probe signal generator for increasing the level of the probe signal while monitoring values of a first quality parameter calculated based on the recorded microphone output signal until the first quality parameter has reached a predetermined first threshold value, and subsequently determining at least one parameter of the feedback path based at least in part on the recorded audio signal.

The signal processor may further be configured for controlling the probe signal generator for refraining from further increasing the level of the probe signal when the first quality parameter has reached the predetermined first threshold value.

The signal processor may further be configured for monitoring values of a second quality parameter calculated based on the recorded microphone output signal, and terminating transmission of the probe signal to the receiver when the determined second quality parameter has reached a predetermined second threshold value.

The signal processor may further be configured for estimating the impulse response of the feedback path.

The Digital Feedback Suppression Circuit may form a feed forward control circuit.

The Digital Feedback Suppression Circuit may form a feedback control circuit and thus, a hearing instrument is provided comprising a microphone for converting incoming sound into an audio signal, a Digital Feedback Suppression Circuit for generating a feedback compensation signal by modelling an external feedback path of the hearing instrument, a subtractor for subtracting the feedback compensation signal from the audio signal to form a feedback compensated audio signal, a signal processor connected for reception of the feedback compensated audio signal and configured for processing the compensated audio signal, a receiver connected to an output of the signal processor for converting the processed signal into a sound signal, a probe signal generator controlled by the signal processor for generation of a probe signal to the receiver for conversion into an acoustic probe signal output by the receiver, and wherein the signal processor is further configured for recording the microphone output signal, and determining parameters of the Digital Feedback Suppression Circuit based on the recorded microphone output signal, wherein the signal processor is further configured for controlling the probe signal generator for increasing the level of the probe signal while monitoring values of a first quality parameter calculated based on the recorded microphone output signal until the first quality parameter has reached a predetermined first threshold value, and subsequently determining at least one parameter of the feedback path based at least in part on the recorded audio signal.

The Digital Feedback Suppression Circuit may be included in the signal processor.

In accordance with some embodiments, a method of modelling a feedback path from a receiver to a microphone in a hearing instrument, includes applying an electronic probe signal with an increasing level as a function of time to the receiver for conversion of the electronic probe signal into an acoustic probe signal output by the receiver, monitoring values of a first quality parameter calculated based at least in part on recorded microphone output signal, and after the first quality parameter reaches a predetermined first threshold value, determining at least one parameter of the feedback path based at least in part on the recorded microphone output signal values.

In accordance with other embodiments, a hearing instrument includes a microphone for converting incoming sound into a microphone audio signal, a Digital Feedback Suppression Circuit for modelling a feedback path of the hearing instrument, a signal processor for processing the audio signal, a receiver connected to an output of the signal processor for converting the processed audio signal into a sound signal, and a probe signal generator controlled by the signal processor for providing a probe signal to the receiver, wherein the receiver is configured for converting the probe signal into an acoustic probe signal output, wherein the signal processor is configured for (1) recording the microphone audio signal, (2) controlling the probe signal generator for increasing a level of the probe signal, (3) monitoring values of a first quality parameter calculated based at least in part on the recorded audio signal; and (4) determining at least one parameter of the feedback path based at least in part on the recorded audio signal after the first quality parameter has reached a predetermined first threshold value.

DESCRIPTION OF THE DRAWING FIGURES

Figure 2:
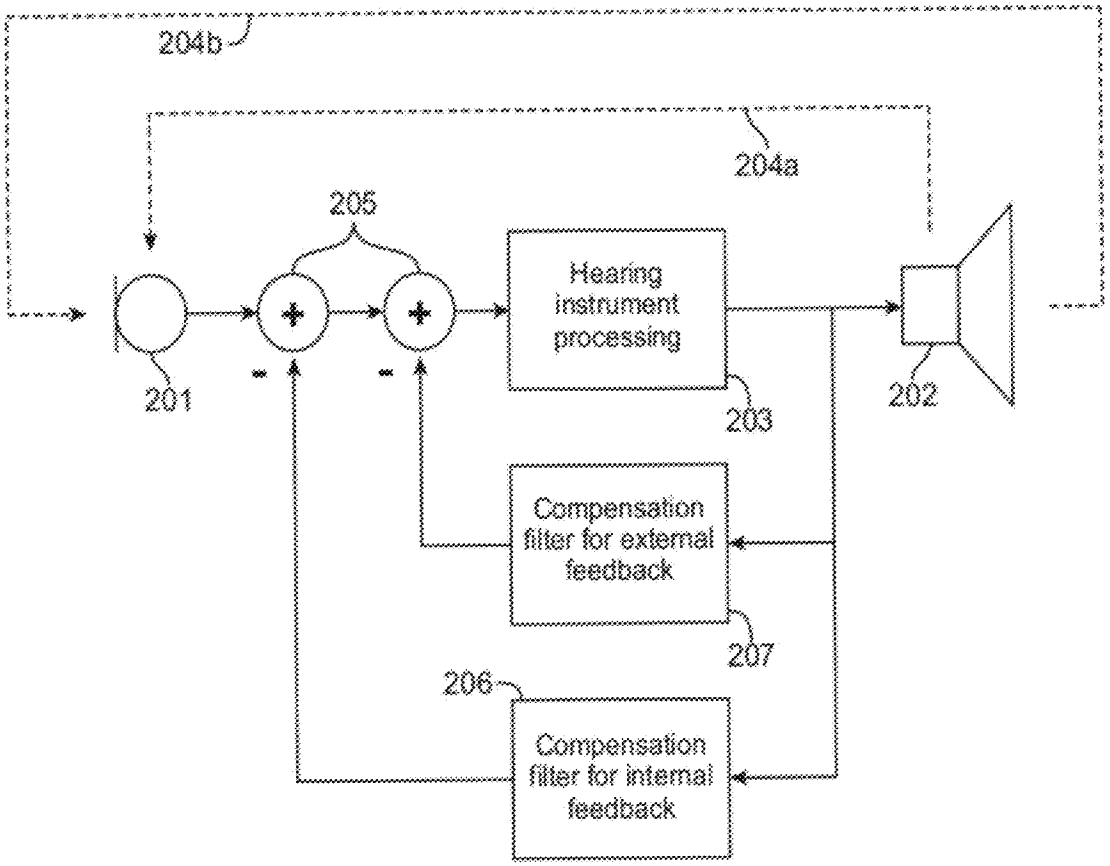
Figure 3:
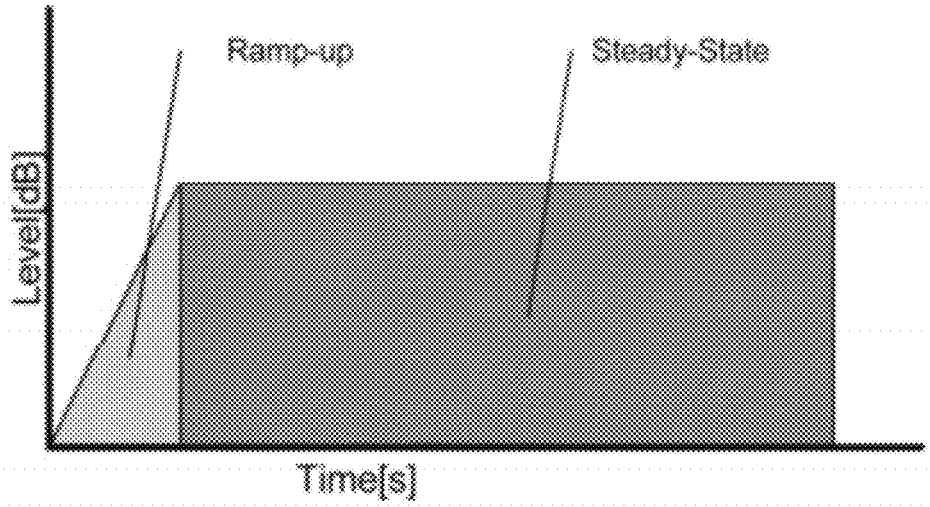
(Prior Art) Fig. 3
Figure 4:
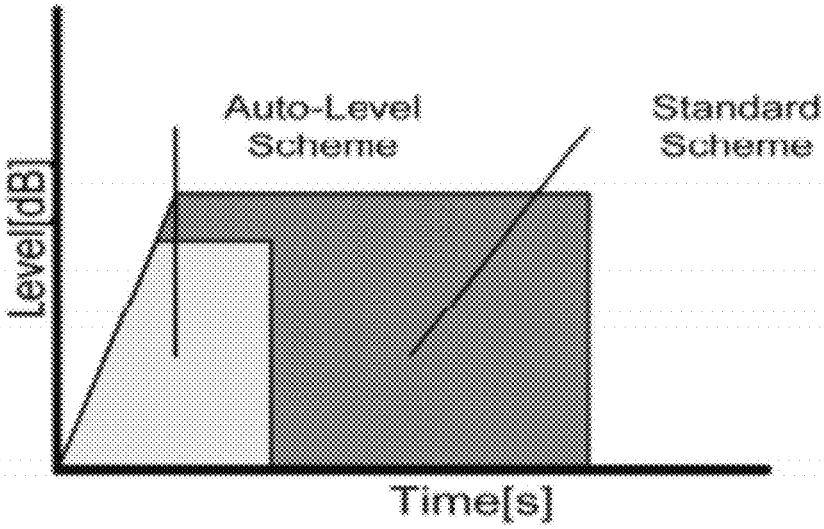
Figure 5:
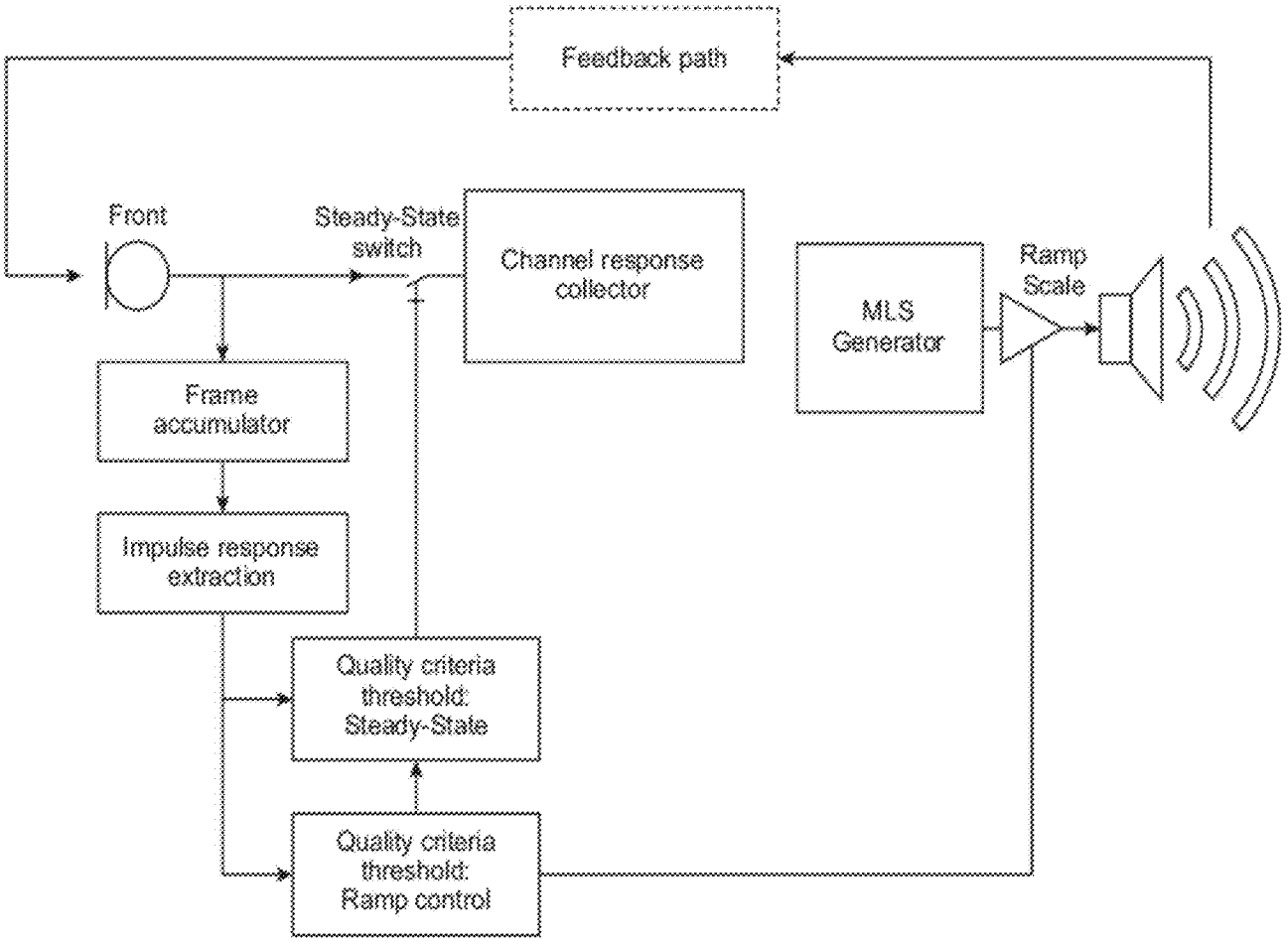

The above and other features and advantages will become more apparent to those of ordinary skill in the art by describing in detail exemplary embodiments thereof with reference to the attached drawings in which:

FIG. 1 shows a block-diagram of a typical hearing instrument system with one feedback compensation filter, FIG. 2 shows a block-diagram of a hearing instrument system with both internal and external feedback compensation filters, FIG. 3 is a plot of a prior art probe signal level as a function of time, FIG. 4 is a plot of the prior art probe signal of FIG. 3 together with a probe signal level according to the present method, and FIG. 5 is a blocked schematic illustrating the operational principles of the present method.

DETAILED DESCRIPTION

The embodiments will now be described more fully hereinafter with reference to the accompanying drawings, in which exemplary embodiments are shown. The embodiments may, however, be embodied in different forms and should not be construed as limited to the embodiments set forth herein. Like reference numerals refer to like elements throughout. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

A block-diagram of a typical (prior-art) hearing instrument with a feedback compensation filter 106 is shown in FIG. 1. The hearing instrument comprises a microphone 101 for receiving incoming sound and converting it into an audio signal. A receiver 102 converts output from the hearing instrument processor 103 into output sound, e.g. modified to compensate for a users hearing impairment. Thus, the hearing instrument processor 103 may comprise elements such as amplifiers, compressors and noise reduction systems etc.

A feedback path 104 is shown as a dashed line between the receiver 102 and the microphone 101. Sound from the receiver 102 may propagate along the feedback path to the microphone 101 which may lead to well known feedback problems, such as whistling.

The (frequency dependent) gain response (or transfer function) $H(\omega)$ of the hearing instrument (without feedback compensation) is given by:

$$H(\omega) = \frac{A(\omega)}{1 - F(\omega)A(\omega)} \tag{1}$$

where $\omega$ represents (angular) frequency, $F(\omega)$ is the gain function of the feedback path 104 and $A(\omega)$ is the gain function provided by the hearing instrument processor 103. When the feedback compensation filter 106 is enabled, it feeds a compensation signal to the subtraction unit 105, whereby the compensation signal is subtracted from the audio signal provided by the microphone 101 prior to processing in the hearing instrument processor 103. The transfer function now becomes:

$$H(\omega) = \frac{A(\omega)}{1 - (F(\omega) - F'(\omega))A(\omega)} \tag{2}$$

where $F'(\omega)$ is the gain function of the compensation filter 106. Thus, the better $F'(\omega)$ estimates the true gain function $F(\omega)$ of the feedback path, the closer $H(\omega)$ will be to the desired gain function $A(\omega)$.

As previously explained, the feedback path 104 is usually a combination of internal and external feedback paths.

A hearing instrument with separate Digital Feedback Suppression Circuits for compensating the internal mechanical and acoustical feedback within the hearing instrument housing and for compensating the external feedback, respectively, is shown in FIG. 2. Again, the hearing instrument comprises a microphone 201, a receiver 202 and a hearing instrument processor 203. An internal feedback path **204*a* is shown as a dashed line between the receiver 202 and the microphone 201. Furthermore, an external feedback path 204*b* between the receiver 202 and the microphone 201 is shown (also dashed). The internal feedback path 204*a* comprises an acoustical connection, a mechanical connection or a combination of both acoustical and mechanical connection between the receiver 202 and the microphone 201. The external feedback path 204*b* is a (mainly) acoustical connection between the receiver 202 and the microphone 201. A first compensation filter 206 is adapted to model the internal feedback path 204*a* and a second compensation filter 207 is adapted to model the external feedback path 204***b*. The first 206 and second 207 compensation filters feed separate compensation signals to the subtracting units 205, whereby both feedback along the internal and external feedback paths 204*a*, 204*b* is cancelled before processing takes place in the hearing instrument processor 203.

The internal compensation filter 206 models the internal feedback path 204*a*, which is usually static or quasi-static, since the internal components of the hearing instrument substantially do not change their properties regarding transmission of sound and/or vibrations over time. The internal compensation filter 206 may therefore be a static filter with filter coefficients derived from an open loop gain measurement, which is preferably done during production of the hearing instrument. However, in some hearing instruments, the internal feedback path 204*a* may change over time, e.g. if the receiver is not fixed and therefore is able to move around within the hearing instrument housing. In this case, the internal compensation filter may preferably comprise an adaptive filter, which adapts to changes in the internal feedback path.

The external compensation filter 207 is preferably an adaptive filter which adapts to changes in the external feedback path 204*b*. These changes are usually much more frequent than the aforementioned possible changes in the internal feedback path 204*a*, and therefore the compensation filter 207 should adapt more rapidly than the internal compensation filter 206.

Because the length of the internal feedback path 204*a* is smaller than the length of the external feedback path 204*b*, the impulse response of the external feedback path 204*b* will be delayed in comparison to the impulse response of the internal feedback path 204*a* when these impulse responses are measured separately. The delay of the external feedback signal depends on the size and shape of the hearing instrument, but will usually not exceed 0.25 ms (milliseconds). Typical delays are 0.01 ms, such as 0.02 ms, such as 0.03 ms, such as 0.04 ms, such as 0.05 ms, such as 0.06 ms, such as 0.07 ms, such as 0.08 ms, such as 0.09 ms, such as 0.1 ms, such as 0.11 ms, such as 0.12 ms, such as 0.13 ms, such as 0.14 ms, such as 0.15 ms, such as 0.16 ms, such as 0.17 ms, such as 0.18 ms, such as 0.19 ms, such as 0.2 ms, such as 0.21 ms, 0.22 ms, such as 0.23 ms, such as 0.24 ms.

The respective impulse responses of the internal and external feedback paths 204*a*, 204*b* also differ in signal level since the attenuation along the internal feedback path 204*a* usually has reached the attenuation along the external feedback path 204*b*. Therefore, the external feedback signal will usually be stronger than the internal feedback signal.

In summary, the internal and external feedback compensation filters 206, 207 differ at least on the following three points:

1. Needed frequency of adaptation,
2. Position of impulse response in the time domain, and
3. Dynamic range of the impulse response.

Thus, provision of two compensation filters 206, 207 saves processing power in comparison to provision of one single adaptive filter due to the higher number of filter coefficients required by the single filter. Furthermore, precision may be improved because of the differences in the dynamic range.

Still further, provision of separate circuits for internal and external feedback compensation, improves the new initialisation process for the same reasons.

The internal compensation filter 206 is preferably programmed during production of the hearing instrument. Thus, when the hearing instrument has been assembled, a model of the internal feedback path is estimated. To get a good estimate of the internal feedback path 204, it is necessary to do a system identification of the hearing instrument with a blocked external feedback path. One way to do this is to place the hearing instrument in a coupler (ear simulator) to provide a suitable acoustic impedance to the receiver, i.e. an impedance substantially equal to the impedance of a wearer's ear. Any leaks, such as vents in In-The-Ear (ITE) hearing instruments, must be sealed, so that all external feedback paths are eliminated. The hearing instrument (and coupler) may further be placed in an anechoic test box to eliminate sound reflections and noise from the surroundings. Then a system identification procedure, such as an open-loop gain measurement, is performed to measure $F(\omega)$, cf. equations (1) and (2) above. One way to perform this is to have the device play back an MLS sequence (Maximum Length Sequence) on the output 202 and record it on the input 201. From the recorded feedback signal the internal feedback path can be estimated. The filter coefficients for the obtained model is then stored in the device and used during operation of the hearing instrument.

FIG. 3 is a plot of a prior art probe signal level as a function of time utilised for initialisation of two individual Digital Feedback Suppression Circuits in a hearing aid with a directional microphone system comprising a front microphone and a rear microphone. During fitting, the hearing aid is connected to a PC, and the illustrated probe signal is transmitted to the receiver of the hearing aid. Based on the microphone output signal that includes a response to the probe signal, the impulse responses of the feedback paths of the front microphone and the rear microphone are estimated. The illustrated probe signal ramps, e.g. linearly on a logarithmic scale, from zero level in one second in order to allow the user to adapt to the probe signal. Subsequently, the probe signal remains at a constant level for 10 seconds. Typically, the constant level is of a magnitude that disturbs the user. The resulting front and rear microphone output signals are transmitted to the PC and the respective impulse responses are calculated. Then the PC determines the required parameters of the respective Digital Feedback Suppression Circuits, e.g. initial filter coefficients of adaptive digital filters, making them capable of modelling the respective feedback paths.

FIG. 4 is a plot of the prior art probe signal of FIG. 3 compared with a probe signal generated in accordance with the new initialisation process. The new probe signal is also ramped initially from a low level to a constant level, however the constant level may be lower than the constant level of the conventional probe signal, and the duration of the probe signal at the constant level may be shorter than the duration of the conventional probe signal at constant level. According to the new initialisation process, the level and duration of the probe signal is kept at a minimum required for the desired quality of initialization of the Digital Feedback Suppression Circuit. Initially, the probe signal is ramped from a low level, such as an inaudible level, e.g. a zero level, while the value of a first quality parameter is monitored. When the first quality parameter value has reached a predetermined first threshold value, the probe signal is kept constant at the corresponding signal level while the value of a second quality parameter is monitored. When the second quality parameter value has reached a predetermined second threshold value, the probe signal level is lowered again, e.g. to an inaudible level, e.g. is turned off.

FIG. 5 schematically illustrates a hearing aid with a Digital Feedback Suppression Circuit initialised in accordance with the new method. The probe signal is a Maximum Length Sequence (MLS) signal generated in the MLS Signal Generator and output to an amplifier (Ramp Scale) with a controlled gain that is controlled as function of time as illustrated in FIG. 4. The feedback signal is received by the microphone and digitised and a block of signal samples is accumulated in the frame accumulator. In the illustrated example, the data block is transferred to a PC for processing to extract the impulse response. The PC performs cross-correlation of the probe signal with the received signal to determine the impulse response. Alternatively, the impulse response may be calculated by the signal processor of the hearing aid itself. The quality of the impulse response is then assessed, in the illustrated example by the PC, but alternatively by the signal processor of the hearing aid. A first quality parameter value is calculated and compared with a first threshold value. If the first quality parameter value has not reached the first threshold value, the probe signal level is increased, otherwise the signal level remains at a constant level and the steady-state measurement stage is entered. A second quality parameter value is calculated and compared to a second threshold value. If the second quality parameter value has not reached the second threshold value, a new block of data is collected and a new second quality parameter value is calculated, otherwise, the initialization sequence is terminated, and in the illustrated hearing aid, the PC calculates the corresponding parameter values of the Digital Feedback Suppression Circuit and transfers the values to the hearing aid.

A maximum allowable signal level and duration of the probe signal may be imposed which are equivalent to what the standard initialization signal level and duration would have been according to the conventional initialisation process.

The quality parameters based on the impulse response of the feedback path may be Peak to Peak Ratio (PPR) of the head and tail parts of an impulse response Noise to Noise Ratio (NNR) of the head and tail parts of an impulse response Peak to Signal-Noise Ratio (PSNR) of the impulse response The impulse response may be extracted by the Digital Signal Processor of the hearing aid. The impulse response may be obtained by cross-correlating the MLS sequence with the received response. Although the DSP operates in a block-based manner, extracting the impulse response is a computationally-intensive process and the cross-correlation cannot be completed within one block. The impulse response extraction has to be spread over many blocks.

The PPR is defined as the ratio of the peak magnitude in the head part to the peak in the tail part of the impulse response, expressed in dB. In this application the head and tail parts are defined as the first-half and last-half of the impulse response respectively.

The NNR is defined as the ratio of the noise level in the head part to the noise level in the tail part of the impulse response, expressed in dB. In this application the head and tail parts are defined as the first-half and last-half of the impulse response respectively. The noise level is computed using the RMS value. In an application without a DC removal filter, the variance could be used to obtain similar results.

PSNR is defined as the ratio of the signal peak to Root-Mean-Square (RMS) noise, expressed in dB. In this application it is estimated as the ratio of the peak magnitude of the extracted impulse response to the RMS value of the last 64 samples of the response.

In the illustrated example, the new initialization process is terminated when both PPR and NNR exceed specific threshold values. The PSNR may also constitute a robust and reliable measure of quality.

The invention claimed is:

1. A method of modelling a feedback path from a receiver to a microphone in a hearing instrument, comprising:

applying an electronic probe signal with an increasing level as a function of time to the receiver for conversion of the electronic probe signal into an acoustic probe signal output by the receiver, monitoring values of a first quality parameter calculated based at least in part on recorded microphone output signal, and after the first quality parameter reaches a predetermined first threshold value, determining at least one parameter of the feedback path based at least in part on the recorded microphone output signal values.

2. The method according to claim 1, wherein the act of applying the electronic probe signal comprises:

refraining from further increasing the level of the probe signal when the first quality parameter has reached the predetermined first threshold value.

3. The method according to claim 1, further comprising:

monitoring values of a second quality parameter calculated based at least in part on the recorded microphone output signal, and terminating the application of the probe signal to the receiver when the second quality parameter has reached a predetermined second threshold value.

4. The method according to claim 3, wherein the first quality parameter and the second quality parameter are identical.

5. The method according to claim 3, further comprising estimating an impulse response of the feedback path, wherein the second quality parameter is a parameter of the impulse response.

6. The method according to claim 3, wherein at least one of the first quality parameter and the second quality parameter is a function of the output signal of the microphone of the hearing instrument.

7. The method according to claim 1, further comprising estimating an impulse response of the feedback path.

8. The method according to claim 7, wherein the first quality parameter is a parameter of the impulse response.

9. The method according to claim 8, wherein the parameter of the impulse response is selected from the group consisting of a Peak-to-Peak ratio of head and tail parts of the impulse response, a Noise-to-Noise ratio of head and tail parts of the impulse response, and a Peak-to-Signal-to-Noise ratio of the impulse response.

10. A hearing instrument comprising:

a microphone for converting incoming sound into a microphone audio signal;

a Digital Feedback Suppression Circuit for modelling a feedback path of the hearing instrument;

a signal processor for processing the audio signal;

a receiver connected to an output of the signal processor for converting the processed audio signal into a sound signal; and a probe signal generator controlled by the signal processor for providing a probe signal to the receiver, wherein the receiver is configured for converting the probe signal into an acoustic probe signal output;

wherein the signal processor is configured for (1) recording the microphone audio signal, (2) controlling the probe signal generator for increasing a level of the probe signal, (3) monitoring values of a first quality parameter calculated based at least in part on the recorded audio signal; and (4) determining at least one parameter of the feedback path based at least in part on the recorded audio signal after the first quality parameter has reached a predetermined first threshold value.

11. The hearing instrument according to claim 10, wherein the signal processor is further configured for controlling the probe signal generator for refraining from further increasing the level of the probe signal when the first quality parameter has reached the predetermined first threshold value.

12. The hearing instrument according to claim 10, wherein the signal processor is further configured for:

monitoring values of a second quality parameter calculated based at least in part on the recorded microphone output signal, and terminating the providing of the probe signal to the receiver when the determined second quality parameter has reached a predetermined second threshold value.

13. The hearing instrument according to claim 12, wherein the signal processor is further configured for estimating an impulse response of the feedback path, and wherein the second quality parameter is a parameter of the impulse response.

14. The hearing instrument according to claim 12, wherein the first quality parameter and the second quality parameter are identical.

15. The hearing instrument according to claim 10, wherein the signal processor is further configured for estimating an impulse response of the feedback path.

16. The hearing instrument according to claim 15, wherein the first quality parameter is a parameter of the impulse response.

17. The hearing instrument according to claim 16, wherein the parameter of the impulse response is selected from the group consisting of the a Peak-to-Peak Ratio of head and tail parts of the impulse response, a Noise-to-Noise Ratio of head and tail parts of the impulse response, and a Peak-to-Signal-to-Noise ratio of the impulse response.

18. The method of claim 1, wherein the acts of applying, monitoring, and determining are performed during a modeling process to model the feedback path from the receiver to the microphone in the hearing instrument.

19. The hearing instrument of claim 10, wherein the processor has a configuration that allows the processor to perform the acts of recording, controlling, monitoring, and determining.

20. The hearing instrument of claim 19, wherein the processor is configured for performing a modeling process that includes the acts of recording, controlling, monitoring, and determining.

* * * * *